United States Patent [19]

Trannoy

[11] 3,986,306

[45] Oct. 19, 1976

[54] PREFABRICATED BUILDINGS HAVING A CENTRAL UNIT AND WALLS THEREABOUT

[76] Inventor: Noël Trannoy, 16, rue Villebois Mareuil, 94 Vincennes, France

[22] Filed: Feb. 21, 1975

[21] Appl. No.: 551,972

Related U.S. Application Data

[63] Continuation of Ser. No. 496,184, Aug. 9, 1974, abandoned, which is a continuation of Ser. No. 44,806, June 9, 1970, abandoned.

[30] Foreign Application Priority Data

June 13, 1969 France ..... 69.19651

[52] U.S. Cl. ..... 52/79; 52/90; 52/93; 52/234

[51] Int. Cl.[2] ..... E04H 1/12; E04C 3/02

[58] Field of Search ..... 52/68, 69, 79, 90, 92, 52/93, 210, 234, 237, 299

[56] References Cited

UNITED STATES PATENTS

| | | | |
|---|---|---|---|
| 1,356,319 | 10/1920 | Smulski | 52/234 |
| 1,789,070 | 1/1931 | Gross | 52/236 |
| 2,154,897 | 4/1939 | Grant | 52/237 |
| 2,396,828 | 3/1946 | Carpenter | 52/92 |
| 3,068,534 | 12/1962 | Hu | 52/90 |
| 3,156,018 | 11/1964 | Slayter | 52/79 |
| 3,295,265 | 1/1967 | Hida | 52/236 |
| 3,449,872 | 6/1969 | Craighead | 52/66 |
| D157,449 | 2/1950 | Tesch | 52/237 X |

FOREIGN PATENTS OR APPLICATIONS

| | | | |
|---|---|---|---|
| 802,592 | 1/1951 | Austria | 52/237 |
| 508,299 | 1/1952 | Belgium | 52/90 |
| 768,344 | 10/1967 | Canada | 52/79 |
| 529,542 | 11/1921 | France | 52/90 |
| 677,078 | 3/1930 | France | 52/234 |
| 1,281,836 | 12/1961 | France | 52/90 |
| 841,888 | 3/1939 | France | 52/90 |
| 302,351 | 7/1968 | Sweden | 52/79 |
| 592,784 | 9/1947 | United Kingdom | 52/90 |
| 1,158,708 | 7/1969 | United Kingdom | 52/79 |

OTHER PUBLICATIONS

Building Block pp. 74–77 and 110–113, Library of Congress TH 1098, N4 copy 2 8/28/68.

*Primary Examiner*—Price C. Faw, Jr.
*Assistant Examiner*—Leslie Braun

[57] ABSTRACT

This invention relates to prefabricated buildings and comprises a central unit having a peripheral section therearound to form a main residential part. This peripheral part is defined by an assembly of juxtaposed roofing and facing trusses; the roofing trusses rest on said central unit and also on the facing trusses which themselves rest on a peripheral support wall. The facing trusses are of triangular section and have an inclined outer wall extending downwardly and beyond the said peripheral support wall.

8 Claims, 11 Drawing Figures

Figure 1:
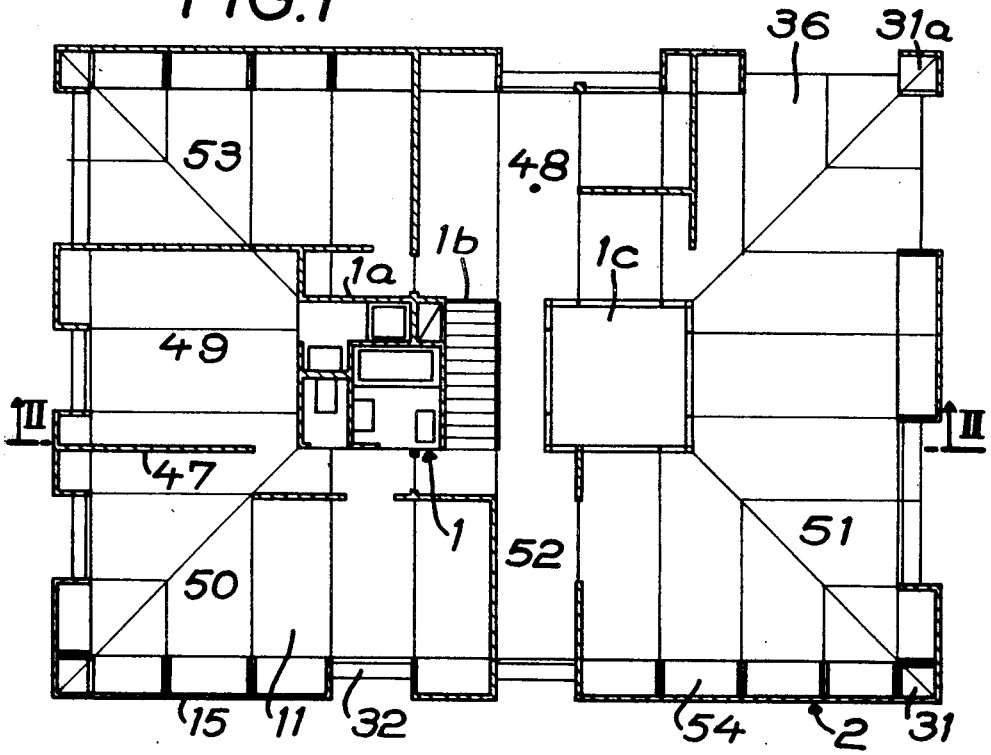

Inventor
NOEL TRANNOY

By John Lezdey
Attorney

FIG.5
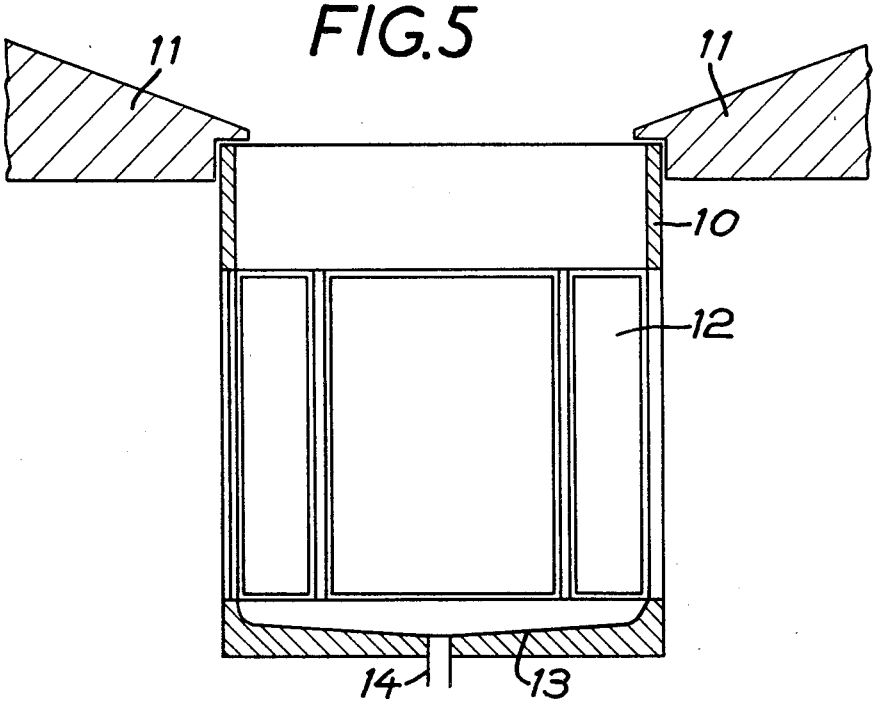
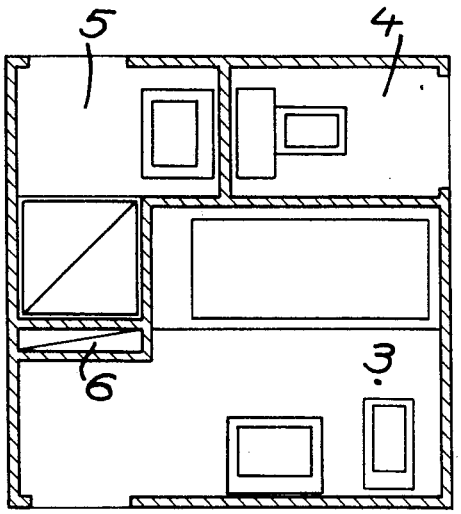
FIG.3
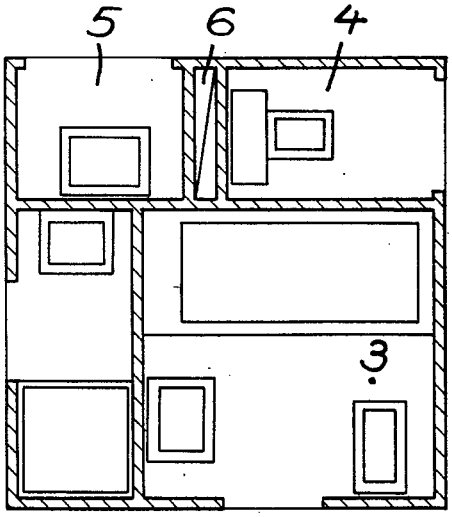
FIG.4
Inventor
NOEL TRANNOY
By John Lezdey
Attorney Inventor
NOEL TRANNOY By John Lezoley
Attorney FIG.10
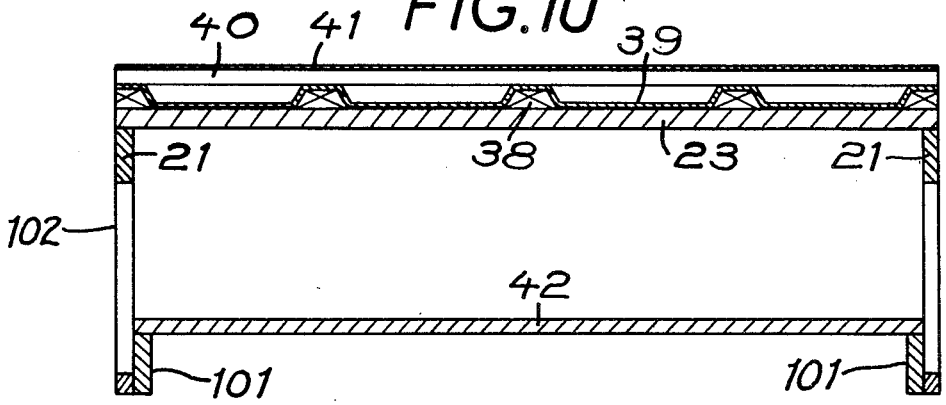
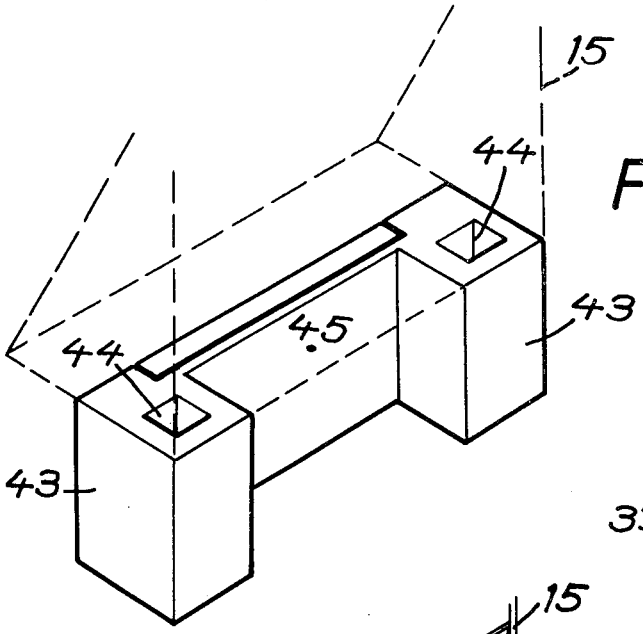
FIG.11
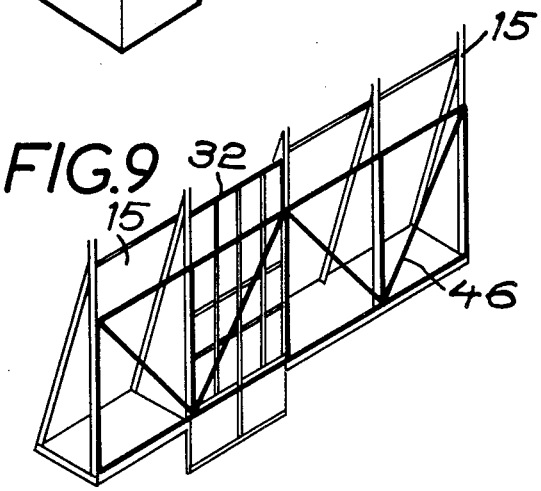
FIG.9
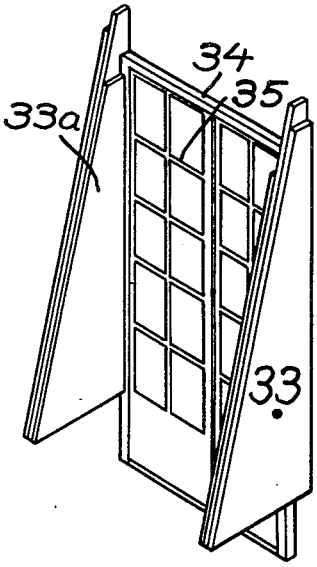
FIG.8
Inventor
NOEL TRANNOY
By John Lezdey
Attorney

PREFABRICATED BUILDINGS HAVING A CENTRAL UNIT AND WALLS THEREABOUT

This is a continuation of application Ser. No. 496,184, filed Aug. 9, 1974, now abandoned; which is a continuation of prior application Ser. No. 44,806, filed June 9, 1970, now abandoned.

The present invention relates to prefabricated buildings, more particularly for use as habitations.

In order to manufacture prefabricated buildings, more particularly residential houses, schools or offices it is known to use a method of construction wherein a central unit of cylindrical shape is raised first of all on foundations, on which a roof of a peripheral part of the building is to be carried. The peripheral part forms the main dwelling part which is closed on its periphery by means of a peripheral partition comprising pillars on which the said roof is to be carried.

In this method reinforced concrete is used to manufacture the central block, pillars and voile forming the roof.

According to another method also known, the central unit is quadrangular and supports the major part of the load of the roof and if desired, the floor of the peripheral section. The partition arranged on the periphery does not participate in the support of the roof.

The central unit is intended most frequently to receive the technical installations such as bathroom, toilet, kitchen, staircase, heating and ventilating plant, certain of which comprise connecting conduits which may be easily linked to general external supply conduits.

However, building constructions employing these methods are mostly produced with conventional materials and do not present a sufficient advantage from the economic point of view over traditional instruction construction, in order to ensure sufficient development.

The building according to the invention is of the type comprising a central unit grouping the technical installations about which a peripheral part extends to form a main residential part.

According to the invention, the peripheral part of the building is defined by an assembly of juxtaposed roofing and facing trusses. These roofing trusses are supported on the one hand on the central unit which comprises at least one member and on the other hand on the facing trusses which rest on a peripheral support wall, which facing trusses are of triangular section and have an inclined outer wall extending to its lower part beyond the support wall.

In this embodiment, the central unit may be made from several members of varying sizes allowing a large number of means of juxtaposition of the technical installations and their combination, more particularly with a member forming an open air patio.

The roofing and facing trusses are of standard dimensions to allow the building to be extended in dependance upon the sizes of the member or members of the central unit.

The general arrangement of the peripheral part allows a permanent seal on the major part of the height of the house and its insulation with respect to the ground.

Finally, the facing trusses impart very great resistance to this unit by reason of the manufacture by triangulation.

These advantages allow an extensive prefabricated building to be obtained at an economic price with respect to traditional constructions.

Figure 2:
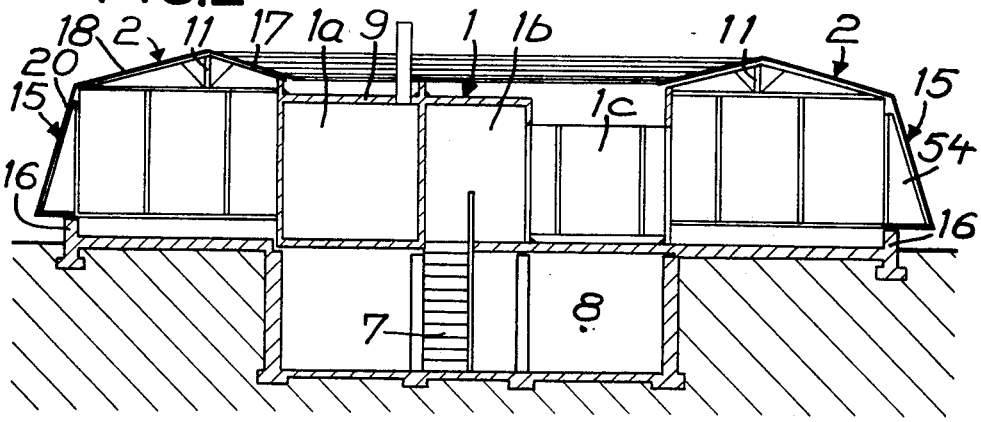
Figure 6:
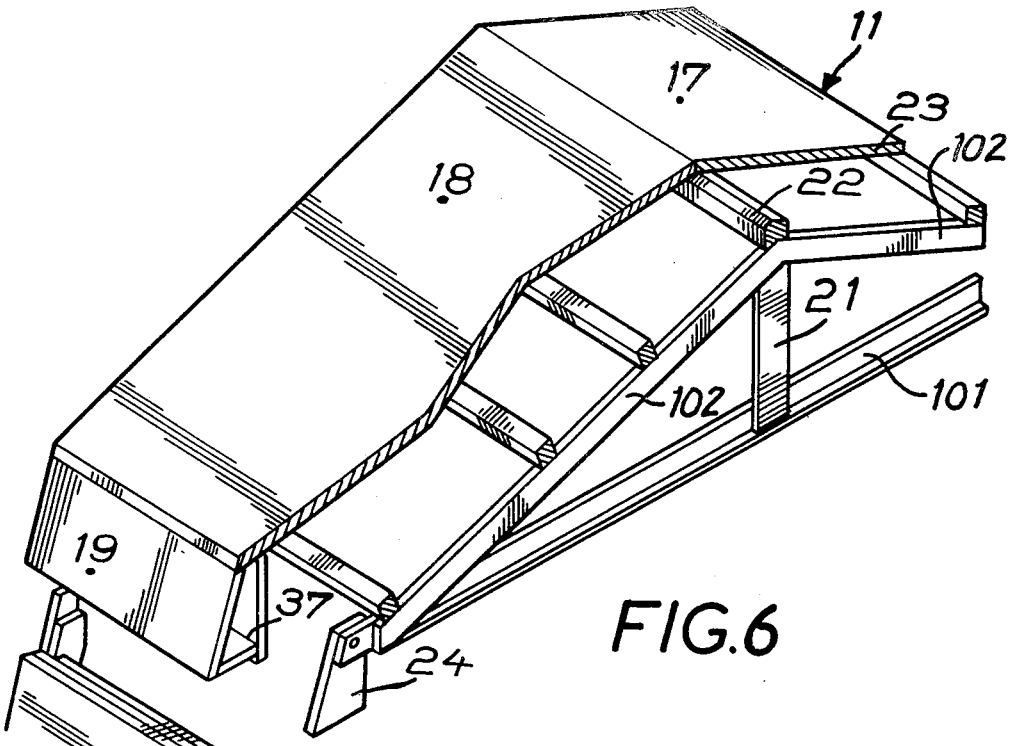
Figure 7:
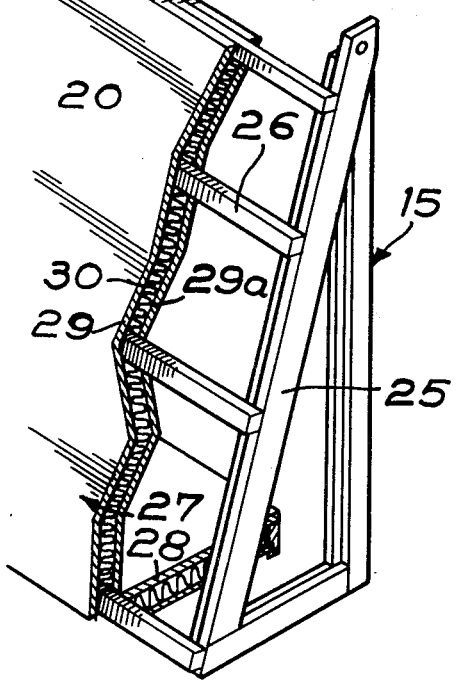

Other characteristics and advantages of the invention will be better understood by a study of the ensuing description of several embodiments and referring to the accompanying drawings, in which:

FIG. 1, is a general plan view of one embodiment of a building according to the invention, FIG. 2, is a sectional view of the building along the line II—II of FIG. 1, FIG. 3, is a plan view of fitted member of the central unit, FIG. 4, is a plan view of a member of the central unit fitted in a different manner, FIG. 5, is an elevational view of a member of the central unit fitted as a patio having sealing with respect to the ground, FIG. 6 is a perspective and sectional view of a covering truss, FIG. 7 is a perspective and sectional view of a facing truss, FIG. 8, is a view in perspective of a facing truss corresponding to a window, FIG. 9, is a view in perspective of several facing and window trusses assembled for transportation thereof, FIG. 10 is a sectional view of a roofing truss, and FIG. 11 is a perspective view of the assembly of a facing truss on foundation piles.

Referring now to the drawings, FIGS. 1 and 2 show one embodiment of a building according to the invention which comprises a central unit 1 about which a peripheral part 2 is arranged to form a main residential section of the whole building.

The central unit 1 comprises a plurality of juxtaposed members 1*a*, 1*c* at least one of which shown as the member 1*a*, is fitted on the inside as shown in FIGS. 3 and 4, to receive more particularly a bathroom 3, a toilet 4, a dressing room 5, and an oulet conduit 6, more particularly for ventilation and heating pipes. The part 1*b* corresponds to a free area defined by 1*a* and 1*c* and covered by a roofing member.

Two different embodiments of suitable arrangements for the central unit are shown in FIGS. 3 and 4, however, it is obvious that such a member is susceptible to a large number of different embodiments and comprising more particularly, as the member 1*b*, a staircase 7 permitting access to a cellar 8 arranged below the building, and a heating or air conditioning installation.

The member 1*a* is provided with a roof 9, although the member 1*c* is made in the form of a patio having no roof.

This member 1*c* is shown in detail in FIG. 5, and its upper part comprises a solid edging strip 10 receiving roofing trusses 11, its central part comprises glazed parts 12, and its lower part comprises a sealing cover 13 and a gutter 14 for draining off rain water.

The peripheral part 2 of the building is defined by roofing trusses 11 and juxtaposed facing trusses 15, the said roofing trusses 11 bearing on the one hand, on the central unit 1 (FIGS. 2 and 5) and on the other hand, on the facing trusses 15 which rest on a peripheral support wall 16.

The roofing trusses (FIG. 6) have three slopes, one slope 17 being directed towards the central unit, one slope 18 being directed to the facade and one slope 19 joining up into a slope 20 of the facing trusses 15.

Each roofing truss 11 (FIG. 6) is formed from a wooden framework (closure member) 21, on which rafters 22 are fixed receiving an agglomerated wooden panel 23, 20 millimeters in thickness approximately, or a thicker panel without rafters. This roofing truss 11 is mounted on a facing truss 15 by an extension 24 which is fixed more particularly by means of bolts on the frame 25 of the facing truss 15.

Each facing truss 15 comprises two frames or uprights 25, triangular in shape, which are interconnected by rafters 26, the said truss being provided on its outer and inner surfaces with panels 27 and 28 each formed from two plates 29, 29*a*, made from agglomerated particles of wood or asbestos cement, between which a layer 30 of an insulating material, more particularly glass wool, is arranged.

Outside this solid facing truss 15 which corresponds to the standard size of a roof truss 11, there are also angle trusses 31 and facing trusses for a window 32, shown on FIG. 8.

The window trusses 32 comprise two triangular panels 33 which are fixed on a framework 34 receiving the battens 35 of a door or a window. These window trusses 32 have the same dimensions as the solid trusses 15 and if desired they may be arranged in place of these latter.

In order to produce a covered porch 36 (FIG. 1) it is necessary to omit on both sides of the angular truss 31*a*, on two sides, two consecutive facing trusses 15.

So as to avoid bending of the trusses for the roof, a reinforcing joist (not shown on the drawing) is mounted in the truss member 37 (FIG. 6) provided on the roofing truss 11.

A method of sealing a roofing truss 11 has been shown in FIG. 10, but it will be apparent that it can also be applied or a facing truss 15 of an angle truss 31.

Wooden slats 38 are nailed on the outer panel 23 of the roofing truss or 29 of the facing truss, which are covered together with the panel 23 with a ceiling cover 39 formed from a supple non-adhesive sheet, retained in place by means of battening 40 perpendicular to the slats 38 and nailed thereto. This battening 40 receives an outer face 41 of the roof which is formed from known material such as slates, plates of asbestos cement, metal, etc.

The actual sealing is ensured primarily by the supple sealing coating.

In the case of the roofing truss 101, the truss rod of the closure member 21 serves as a support for floor panels 42.

The construction of a building according to the invention is effected in the following manner:

The foundations are laid first of all in brickwork, comprising the peripheral wall 16 which comprises (FIG. 11) two concrete piles 43 for each facing truss 15 fixed on the foundations and comprising holes 44 for the bedding of a truss 15.

The piles 43 have a groove intended to receive a slab 45 of expanded concrete.

After making the floor of the building the members 1*a*, 1*c* of the central unit (FIGS. 1 and 2) and of the linking part 1*b* are erected.

Then the trusses are assembled, commencing with the angle trusses 31, the complete facing trusses 15 and the window trusses 32.

In order to faciltate assembly, it is proposed that facing trusses 15 and window trusses 32 mounted on a joist 46 (FIG. 9) be assembled in the factory, but in such manner as to allow transport of the assembly, the said joist being withdrawn after positioning the facade.

The facade unit having been mounted, the roofing trusses 11 are erected to rest on one side on the central unit 1 and on the other side of the facing trusses 15, triangular roofing trusses being provided in the corners.

When the peripheral part is mounted the supple sealing covering 39 is erected as well as the outer face 41.

Then the inner partitions such as 47 are made, which ensure the internal division of the peripheral part 2 into different sections of which there is a kitchen 48, bedroom 49, 50, a lounge 51, an entrance 52, a covered porch 36, and a garage 53.

The central unit comprises a hygiene section 1*a*, a member 1*b* for the staircase 7 and the member 1*c* forming the patio.

The arrangement adopted for the facing trusses has several advantages, more particularly their section of triangular shape allows a slope 20 to be provided for draining off the running water, beyond the support wall 16. In FIG. 10 there is shown a sectional view of the roofing truss wherein the unshaded portion represents a part 102 of truss 21 which is cut between two rafters 22. The unshaded portion of FIG. 10 corresponds to the slanting and unsectioned part of the truss.

Finally, the facing trusses 15 define internally a space 54 forming an additional residential area or utility area which may comprise wall cupboards.

Naturally various modifications may be made by a man skilled in the art to the devices or methods which have been described solely by way of non-limiting example without departing from the scope of the invention, as defined by the appended claims.

I claim:

1. A prefabricatd building comprising a central unit having walls thereabout, a plurality of peripheral sections disposed about the periphery of said central unit, each peripheral section comprising a roofing element having trusses and outwardly facing trusses on the outer side of each peripheral section, said facing trusses including vertical members and outwardly and downwardly extending members, said roofing trusses being supported at their inner ends on the walls of said central unit and at their outer ends on said outwardly facing trusses and a peripheral support wall disposed beneath the vertical members of said outwardly facing trusses, the lower ends of said vertical members of said outwardly facing trusses being supported on said peripheral support wall and said downwardly and outwardly extending members of said outwardly facing trusses being inclined outwardly to extend outwardly beyond said support wall.

2. A building as claimed in claim 1 wherein said central unit comprises a plurality of central sections having different dimensions in the horizontal plane.

3. A building as claimed in claim 1 wherein the trusses of said roofing elements and the outwardly facing trusses of said peripheral sections have substantially the same configuration and dimensions.

4. A building as claimed in claim 1 wherein at least one peripheral section comprises at least two spaced outwardly facing trusses and a window unit disposed between the spaced vertical member of each of said at least two spaced trusses.

5. A building as claimed in claim 1 wherein said roofing element of each peripheral section includes a substantially central ridge member and downwardly sloping roof section, one section extending downwardly to the wall of said central unit a second section to said outwardly facing trusses of said peripheral section, and a third section forming a skirt element about the top of said outwardly facing trusses.

6. A building as claimed in claim 1 wherein said roofing element and said outwardly facing trusses are covered with a weather-resistant covering.

7. A building as claimed in claim 1 wherein said central unit includes a roofing element.

8. A building as claimed in claim 1 wherein said central unit is open at the top thereof to provide a patio and wherein said central unit further comprises means for sealing the bottom of the walls thereof to the ground.

* * * * *